US007039489B2

(12) United States Patent
Siegl

(10) Patent No.: US 7,039,489 B2
(45) Date of Patent: May 2, 2006

(54) MONITORING OF THREAD TRANSPORT

(75) Inventor: Walter Siegl, Stäfa (CH)

(73) Assignee: Sultex AG, Ruti (CH)

( * ) Notice: Subject to any disclaimer, the term of this patent is extended or adjusted under 35 U.S.C. 154(b) by 33 days.

(21) Appl. No.: 11/077,762

(22) Filed: Mar. 10, 2005

(65) Prior Publication Data

US 2005/0203659 A1 Sep. 15, 2005

(30) Foreign Application Priority Data

Mar. 12, 2004 (EP) ..... 04405149

(51) Int. Cl.
*G06F 19/00* (2006.01)

(52) U.S. Cl. ..... 700/140; 139/212

(58) Field of Classification Search ..... 700/140; 139/194, 370.1, 370.2, 336, 450, 452, 212
See application file for complete search history.

(56) References Cited

U.S. PATENT DOCUMENTS 3,824,401 A * 7/1974 Suzuki ..... 139/370.1
5,669,421 A 9/1997 Lehnert et al.
6,328,081 B1 * 12/2001 Gotti et al. ..... 139/450
6,810,918 B1 * 11/2004 Birner et al. ..... 139/452

FOREIGN PATENT DOCUMENTS

EP 0501920 A1 9/1992
EP 0573656 A1 12/1993

* cited by examiner

*Primary Examiner*—John J. Calvert
*Assistant Examiner*—Brian Kauffman
(74) *Attorney, Agent, or Firm*—Townsend and Townsend and Crew LLP

(57) ABSTRACT

A method for monitoring the transport of a thread in a weaving machine is presented in which the thread includes thread sections (21, 21.*i*) which are transported with an associated speed ($v_i$). In this method, values (24) of at least one kinematic measurement parameter of at least one thread section (21, 21.*i*) are measured and, based on the measured values (24), approximation values (25) of the tensile force which acts on at least one thread section (21, 21.*i*) are calculated by means of a computation model (2). The computed approximation values (25) are displayed for monitoring purposes.

17 Claims, 3 Drawing Sheets

MONITORING OF THREAD TRANSPORT

BACKGROUND OF THE INVENTION

The invention relates to a method for monitoring the transport of a thread, in particular the insertion of a weft thread in a weaving machine, and to a weaving machine which is equipped for carrying out a method of this kind.

Within the framework of general process optimization and automation in textile technology the measurement and monitoring of the instantaneous dynamic process parameters which are characteristic for the thread transport are given great importance. In the following, dynamic process parameters will be understood to mean principally parameters which effect a movement of the thread, i.e. forces which act on the thread. For example, in current weaving machines, the warp thread tensions are measured and used for regulation of the warp thread let-off drive. In contrast, in current weaving machines the measurement of the thread tensile forces which act on a weft thread takes place mostly only within the framework of experimental projects. This restriction can largely be attributed to the fact that the thread must be deflected for the measurement of the thread tensile force in order to produce a normal force which acts on the measurement cell. If a deflection is not already present which can be utilized, then an additional deflection is required, which can severely hinder the thread transport depending on the deflection angle. This holds in particular for weaving machines with air insertion systems. Analogously to this, there is a large number of situations in textile machines in which the direct measurement of the desired dynamic process parameters which are characteristic for the thread transport presents difficulties or is associated with greater cost and complexity. This holds, e.g., for measurements over longer transport sections or at points which are difficult to access, or for the measurement of thread tensile forces which arise in the thread transport that could not be previously carried out without contact.

SUMMARY OF THE INVENTION

An object of the present invention is to make available a method for the monitoring of the transport of a thread, in particular the insertion of a weft thread in a weaving machine, by means of which approximation values of at least one dynamic process parameter which is characteristic for the thread transport can be determined. In particular, approximation values for a thread tensile force which acts at a thread point or on a thread section should be determined with the method, and in particular the measurement parameters which are required for this should be measurable without contact where required. A further object of the invention is to make available a weaving machine which is equipped for carrying out a method of this kind.

In the method in accordance with the invention for monitoring the transport of a thread, in particular the insertion of a weft thread in a weaving machine, the thread includes thread points or thread sections which are each transported with an associated speed; and values of at least one measurement parameter which is dependent on the thread transport of at least one thread point or thread section are measured, for example values of a kinematic measurement parameter, such as the above-mentioned speed. In the method in accordance with the invention, approximation values of at least one dynamic process parameter which is characteristic for the thread transport, for example approximation values for the thread tensile force, are calculated based on the measured values for at least one thread point or thread section by means of a computation model, and the computed approximation values are evaluated for monitoring the thread transport, with the computed approximation values in particular being displayed and/or used for controlling the thread transport.

The computational model which is used for the computation of the approximation values is preferably formed as a simulation model for the thread transport, in particular as a simulation model in accordance with the method of finite elements. The computational model, or the simulation model, expediently contains model parameters, with at least some of the measured values being used as control parameters for the iterative adaptation of the model parameters in a preferred variant.

The thread is preferably transported substantially rectilinearly and the computational model or the simulation model is preferably made one-dimensional. The thread is advantageously modeled, for example as a one-dimensional continuum oscillator or as a one-dimensional oscillation chain. The use of simple empirical computational models is also possible.

In an advantageous embodiment of the method the temporal variation of the approximation values of at least one dynamic process parameter which is characteristic for the thread transport is calculated for at least one thread point or thread section by means of the simulation model over a transport period. In a further advantageous embodiment the local variation of the approximation values of at least one dynamic process parameter which is characteristic for the thread transport is calculated by means of the simulation model over at least a partial length of the thread.

In a preferred embodiment of the method, approximation values for the thread tensile force which act at least at one thread point or on at least one thread section are computed, with a series of approximation values for the thread tensile force which acts at least at one thread point or on least at one thread section being calculated over the insertion period of a weft thread in a preferred variant.

In a further preferred embodiment of the method the values of at least one measurement parameter which depends on the thread transport, preferably of a kinematic measurement parameter, are measured without contact.

Values of the following measurement parameters are preferably measured: starting time in a predetermined position, arrival time at a predetermined position, displacement after a specific period of time or speed. In a weaving machine the weft thread is mostly drawn off from a drum-like thread storage apparatus. In this process the drawing off of a weft thread section is preferably measured by means of a so-called turn counter in order to determine the starting time and/or the draw-off speed of the weft thread section from the corresponding turn counter signals.

Furthermore, the invention comprises a textile machine, in particular a weaving machine, which is equipped for carrying out one of the above-described methods.

The method in accordance with the invention has the advantage that approximation values for a large number of dynamic and kinematic process parameters which are characteristic for the thread transport can be computed as a result of comparatively few measurement values for monitoring the thread transport in a textile machine and in particular in a weaving machine. In particular it is possible to determine the measurement values without contact, so that disturbing influences on the thread transport are avoided. Thus, it is, for example, possible for the first time to determine, without contact, approximation values for the thread tensile forces which act on the weft thread during the insertion of a weft thread in a weaving machine. The approximation values which are computed by means of the method in accordance with the invention can for example be displayed for monitoring the thread transport, through which e.g. the setting of the thread transport is facilitated, or can trigger an alarm in the event that a predetermined limiting value of the relevant process parameter is exceeded, or can also be used for controlling the thread transport. The computation of the approximation values can take place periodically, which is sufficient e.g. for setting purposes. It is however also possible to determine measurement values of at least one measurement parameter which is dependent on the thread transport quasi continuously and to carry out the computation of the approximation values of at least one process parameter which is characteristic for the thread transport immediately afterwards, so that "quasi instantaneous" approximation values are available for the monitoring of the thread transport.

The invention will be explained in the following in more detail with reference to the exemplary embodiment and with reference to the drawings.

DESCRIPTION OF THE PREFERRED EMBODIMENTS

Figure 1:
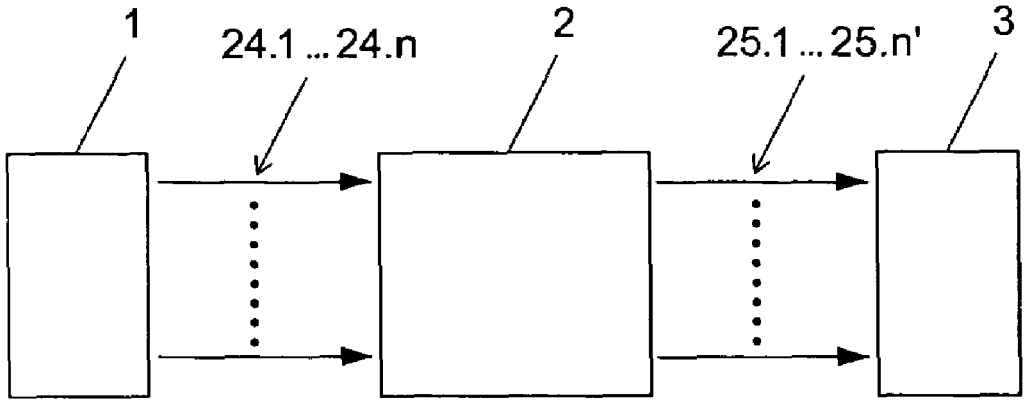
FIG. 1 is a schematic illustration of an exemplary embodiment of the method in accordance with the present invention.

FIG. 1 shows a schematic illustration of an exemplary embodiment of a method in accordance with the present invention. In the exemplary embodiment the insertion of a weft thread in an air jet weaving machine is monitored. The method in accordance with the invention is of course also suitable for the monitoring of the thread transport in other weaving machines or in other technical applications. The weft thread of the exemplary embodiment includes thread points or thread sections which are each transported with an associated speed $v_i$. The measurement of values 24.1–24.*n* of at least one measurement parameter which is dependent on the thread transport for at least one thread point or thread section is summarized under the reference symbol 1 in FIG. 1. Included under the reference symbol 1 are also the measurement pickups which are used for the measurement of the values 24.1–24.*n* and the hardware which is required for the preparation and evaluation of the corresponding measurement signals. Typically, values of at least one kinematic parameter are measured, such as for example the starting time in a predetermined position, the arrival time at a predetermined position, the displacement after a specific period of time or the speed. In a preferred variant the values 24.1–24.*n* are measured without contact. For example, the passage of the weft thread during the drawing off from a drum-like thread storage is detected by means of a so-called turn counter, and the starting time and/or the draw-off speed of the relevant weft thread section is/are determined from the corresponding turn counter signals, or the speed is measured by means of optical correlation or is measured by means of a spatial filter method with electrostatic signal generation in accordance with DE 199 00 581 A1. Furthermore, the arrival time of the weft thread at a predetermined position, in particular at the end of the weft insertion, can be measured without contact, e.g. by means of a weft thread monitor.

The measured values 24.1–24.*n* are transmitted to a computational model 2 in the exemplary embodiment, for example by deposition of the values in a memory to which the computational model 2 has access. As a result of the measured values, approximation values 25.1–25.*n*' of at least one dynamic process parameter which is characteristic of the thread transport are calculated by means of the computational model 2 for at least one thread point or thread section, e.g. the thread tensile force which acts at least at one thread point or at least on one thread section. The computational model 2 which is used will be explained in more detail below in the context of the description of FIGS. 2 to 5. Included under the reference symbol 2 is also the physical implementation of the computational model, which includes in particular a computational unit and a data memory and a program memory in which the computational model is stored. The computational unit and the data memory and the program memory are advantageously integrated into or implemented in a control system for the thread transport and/or into/in a machine control unit, for example into/in a control unit of the weaving machine.

In an advantageous variant the temporal variation of the approximation values 25.1–25.*n*' of at least one dynamic process parameter which is characteristic for the thread transport is calculated by means of the simulation model over a transport period, for example over the duration of the weft insertion, for at least one thread point or thread section. In a further advantageous variant the local variation of the approximation values 25.1–25.*n*' of at least one dynamic process parameter which is characteristic for the thread transport is calculated over at least a partial length of the thread by means of the simulation model.

In the exemplary embodiment the computed approximation values 25.1–25.*n*' are transmitted to an evaluation unit 3 which includes for example a display function or display apparatus, an alarm function or alarm apparatus or control functions for controlling the thread transport and/or further machine parts. In the evaluation unit 3 the computed approximation values 25.1–25.*n*' are evaluated for monitoring the thread transport and are in particular displayed and/or used for the control of the thread transport or of further machine functions.

The computational model 2 which is used for the computation of the approximation values is preferably formed as a simulation model for the thread transport, for example as a simulation model in accordance with the method of finite elements. The thread is advantageously transported substantially rectilinearly, so that a one-dimensional computational model or simulation model can be used. The restriction to a rectilinear thread transport deviates strongly from reality, since the thread executes oscillations in all degrees of freedom or is deflected in all degrees of freedom during the transport, as far as possible. An exact analytical description of the thread movement in space is however generally not feasible, since the influencing parameters which are required for this can hardly be measured with the required precision.

Transport paths with simple deflections of the thread direction can, on the other hand, frequently also be approximately computed with a one-dimensional simulation model in that deflections e.g. are taken into account in the model as braking components. The thread is, for example, advantageously modeled as a one-dimensional continuum oscillator or as a one-dimensional oscillation chain. The use of simple empirical computational models is also possible if no special requirements are placed on the precision of the computed approximation values.

Figure 2:
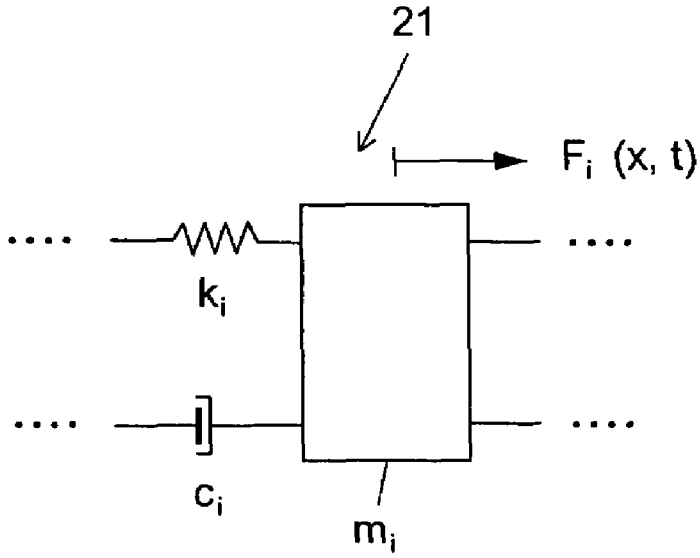
FIG. 2 shows a variant of a cell of a computational model for use in the exemplary embodiment which is shown in FIG. 1.

In a preferred embodiment of the computational model or of the simulation model the thread is treated as a one-dimensional oscillation chain, i.e. as an oscillating body with a number of cells or thread sections. FIG. 2 shows a variant of a cell of a computational model of this kind. The cell 21 or the corresponding thread section respectively has a mass $m_i$, an elasticity constant $k_i$, and a damping $c_i$. Furthermore, an external force $F_i(x, t)$, which can be dependent on both position and time, acts on the cell 21. Examples for an external force of this kind are the drive force of an air nozzle in an air jet insertion system, the action of which depends on the distance between the cell and the nozzle, or the braking force of a thread brake which is disposed in the transport path. The drive force of an air nozzle is normally not measured directly, but at least approximation values for the drive force can be determined on the basis of known values for the air pressure and blowing time and on the basis of the distance between the cell and the nozzle.

Figure 3:
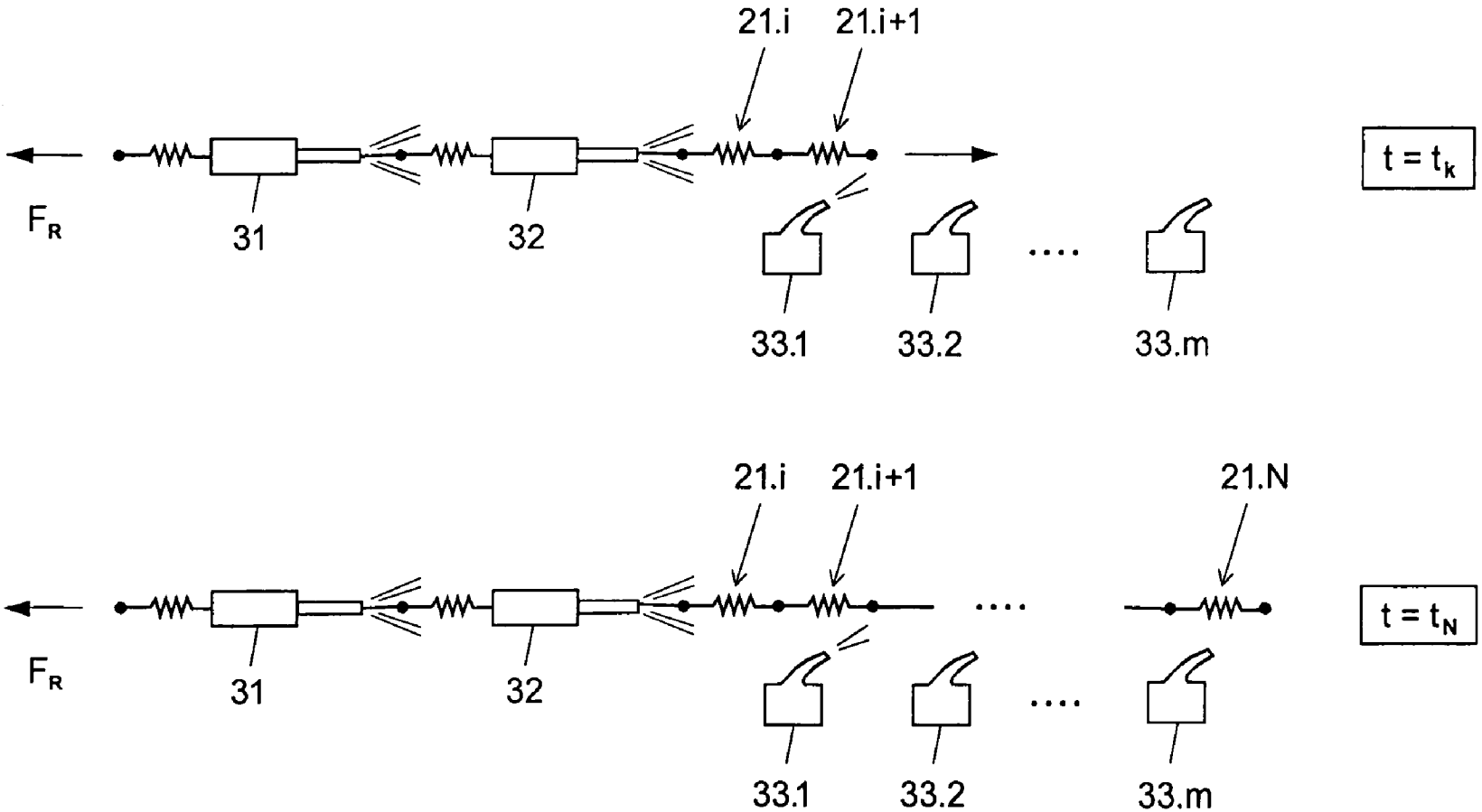
FIG. 3 shows a model-type illustration of a variant of the thread transport relating to the exemplary embodiment which is shown in FIG. 1.

FIG. 3 shows a model-type illustration of a variant of the thread transport relating to the exemplary embodiment which is shown in FIG. 1. This variant relates to the insertion of a weft thread in an air jet weaving machine. The illustration shows the weft thread at two different time points $t_k$ and $t_N$, during and at the end of the weft insertion respectively. The weft thread includes thread sections 21.*i*, 21.*i*+1, 21.N which divide up the free thread length into a maximum of N cells. It is to be observed that in this variant the number of cells which are used for the computation increases continuously during the weft insertion until the maximum number N of cells is reached at the end of the weft insertion at the time point $t_N$. The numbering of the cells was chosen in the present variant such that each cell newly entering the computation receives the number 1, while the numbers of the previous cells are increased by one. In this way the number of the cell belonging to the weft thread tip increases continuously during the weft insertion until it reaches the value N. The weft thread is accelerated in a known manner by means of the air nozzles 31, 32, 33.1–33.*m* which are shown in FIG. 3. Typical nozzle arrangements include e.g. a main nozzle 31, a tandem nozzle 32 and a series of relay nozzles 33.1–33.*m*.

Figure 4:
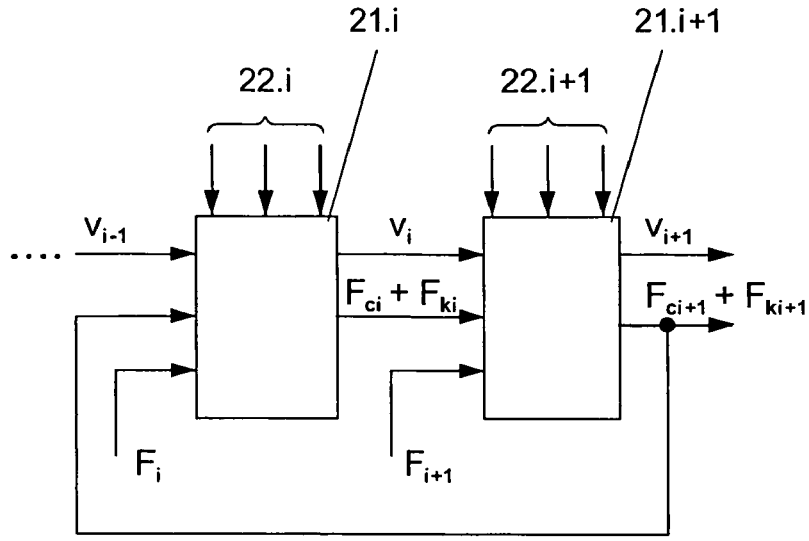
FIG. 4 shows two successive cells of the variant which is shown in FIG. 3.

FIG. 4 shows a variant of two successive cells 21.*i*, 21.*i*+1 in detail. The cells are transported with respective speeds $v_i$, $v_{i+1}$. The cells 21.*i*, 21.*i*+1 have model parameters 22.*i*, 22.*i*+1, for example a mass $m_i$, $m_{i+1}$, an elasticity constant $k_i$, $k_{i+1}$, and a damping $c_i$, $c_{i+1}$. Normally it is sufficient to assume the named model parameters to be spatially and temporally constant over a computation period, so that in this case no mass balances need be taken into account. In contrast, it can be expedient to take into account the dependence of individual model parameters on dynamic or kinematic process parameters. Thus, e.g., the elasticity constant depends on the thread tensile force, with the plot normally being asymmetrical; or the damping depends on the speed $v_i$, $v_{i+1}$. External forces act on each of the cells 21.*i*, 21.*i*+1, the resultants of which are designated in FIG. 4 by $F_i$ and $F_{i+1}$ respectively, and which can vary temporally and/or spatially. Examples for external forces of this kind are the drive force of an air nozzle in an air jet insertion system, the action of which depends on the distance between the cell and the nozzle and the switch-on time, or the temporally variable braking force of a thread brake which is disposed in the transport path. The following balance of forces holds for the i-th cell 21.*i*:

$$F_{ki}+F_{ci}=F_i+F_{mi}+F_{ki+1}+F_{ci+1}$$

where $F_{ki}$=the thread tensile force acting on the i-th cell
$F_{ci}$=the damping force acting on the i-th cell
$F_i$=the resultant of the external forces acting on the i-th cell
$F_{mi}$=the inertial force acting on the i-th cell
$F_{ki+1}$=the thread tensile force acting on the i+1-th cell
$F_{ci+1}$=the damping force acting on the i+1-th cell with $dF_{ki}/dt=k_i\cdot(v_{i-1}-v_i)$
$F_{mi}=m_i\cdot dv_i/dt$
$F_{ci}=c_i\cdot(v_{i-1}-v_i)$ where $k_i$=elasticity constant of the i-th cell
$v_i$=speed of the i-th cell
$v_{i+1}$=speed of the i-1-th cell
$m_i$=mass of the i-th cell
$c_i$=damping of the i-th cell The cells 21.*i*, 21.*i*+1 can be compounded to a complete computational model for the thread transport, as is schematically illustrated in FIG. 3. In this situation the maximum number N of cells depends on the desired spatial and temporal resolution of the model. The thread transport is advantageously assumed to be rectilinear and/or the computational model is preferably made one-dimensional.

The above-described computational model permits the computation of an oscillatory body with N cells. I.e. through the solution of the listed differential equations, approximation values for all dynamic and kinematic parameters which occur in the model can be computed over a desired transport period, in particular the thread tensile force which acts on a cell or on a thread section respectively. The model parameters 22.*i*, 22.*i*+1 which are required for this can either be determined separately or with the help of the model in that, for example, some of the measured values are used as control parameters for the iterative adaptation of the model parameters. Model parameters, such as for example the mass $m_i$ of a cell or of a thread section respectively, can be determined separately without difficulty by weighing, as long as the mass is sufficiently constant over the length of the thread. Model parameters such as for example the damping $c_i$ of a cell can, in contrast, be separately determined only with greater difficulty, in particular when the damping varies over the length of the thread. Model parameters such as e.g. the damping are advantageously determined computationally.

Figure 5:
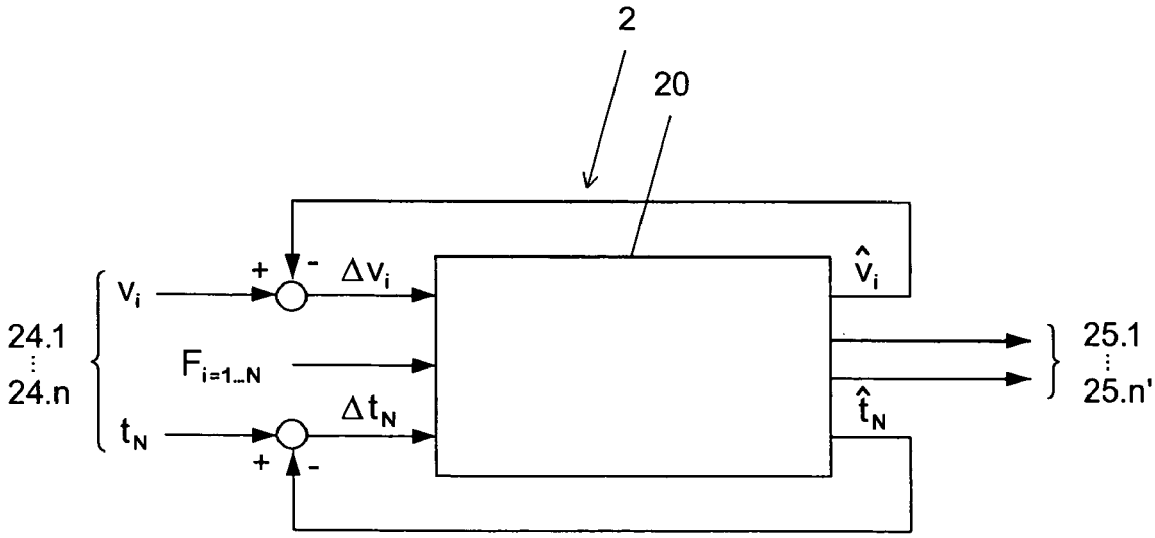
FIG. 5 is a schematic illustration of the parameter adaptation relating to the exemplary embodiment which is shown in FIG. 1.

FIG. 5 shows a schematic illustration of a variant of the computational model for the iterative parameter adaptation and/or optimization. Values 24.1–24.*n* of at least one measurement parameter which is dependent on the thread transport, for example values $v_i$ of the thread draw-off speed, which can for example be determined quasi continuously from turn counter signals, and the arrival time $t_N$ of the weft thread tip at the end of the weft insertion, are supplied to a total model 2, which includes a computational model 20, for example a computational model such as was explained in the context of the description of FIG. 4. The supplied values can be used once or continuously, in particular iteratively, to adapt or to optimize individual model parameters in that the relevant model parameters are varied such that the difference $\Delta v_i$, $\Delta t_N$ between the measured values $v_i$, $t_N$ and the corresponding computed values $\hat{v}_i$, $\hat{t}_N$ is a minimum. At the same time each computational pass or run yields approximation values 25.1–25.*n*' for desired dynamic or kinematic process parameters which are characteristic for the thread transport, for example approximation values for the thread tensile force which acts in a thread section.

The method in accordance with the invention for monitoring the thread transport has the advantage that approximation values for process parameters which are characteristic of the thread transport and which could otherwise be determined only with greater cost and complexity or with difficulty can be determined from simple-to-measure values of at least one measurement parameter which is dependent on the thread transport by means of a computational model. In this way it is for example possible to determine without contact approximation values for the thread tensile force which acts in a thread section. The computed approximation values are then evaluated for monitoring the thread transport, for example in that the approximation values are displayed or are used for controlling the thread transport. In an advantageous embodiment the computation and/or evaluation of the approximation values is integrated into or implemented in a control of the thread transport and/or into/in a machine control unit, for example into/in a control unit of the weaving machine.

The invention claimed is:

1. Method for monitoring the transport of a thread in a weaving machine comprising transporting thread points or thread sections with an associated speed; measuring values of at least one measurement parameter which is dependent on the thread transport of at least one thread point or thread section; calculating, based on the measured values, approximation values of at least one dynamic process parameter which is characteristic of the thread transport for at least one thread point or thread section by means of a computation model, the computation model being designed as a simulation model for the thread transport in accordance with the method of finite elements; and evaluating the computed approximation values for monitoring the thread transport.

2. Method in accordance with claim 1, with the computation model, containing model parameters, and with at least some of the measured values being used as control parameters for the iterative adaptation of the model parameters.

3. Method in accordance with claim 1, with the temporal variation of the approximation values of at least one dynamic process parameter which is characteristic for the thread transport being calculated for at least one thread point or thread section by means of the simulation model over a transport period.

4. Method in accordance with claim 1, with the local variation of the approximation values of at least one dynamic process parameter which is characteristic for the thread transport being calculated by means of the simulation model over at least a partial length of the thread.

5. Method in accordance with claim 1, with the approximation values for the thread tensile force which acts at least at one thread point or at least on one thread section being calculated, and in particular with a series of approximation values for the thread tensile force which acts at least at one thread point or on least at one thread section being calculated over the insertion period of a weft thread.

6. Method in accordance with claim 1, with approximation values of a parameter which is dependent on the thread tensile force, being calculated or evaluated.

7. A method according to claim 6 wherein the approximation values being calculated or evaluated comprise approximation values of the thread tension or the thread elongation.

8. Method in accordance with claim 1, with the values of at least one measurement parameter which is dependent on the thread transport being measured contactlessly, and/or with values of one of the following measurement parameters being measured: starting time in a predetermined position, arrival time at a predetermined position, displacement after a specific period of time or speed.

9. Method in accordance with claim 1, with the thread being substantially transported in a straight line and/or with the computation model, i.e. the simulation model, being designed to be one-dimensional.

10. Weaving machine equipped for carrying out a method in accordance with claim 1.

11. A method according to claim 1 wherein the at least one measurement parameter is a kinematic measurement parameter.

12. A method according to claim 1 wherein evaluating the computed approximation values comprises displaying and/or using the computed approximation values for controlling the thread transport.

13. Method for monitoring the transport of a thread in a weaving machine comprising transporting thread points or thread sections with an associated speed; measuring values of at least one measurement parameter which is dependent on the thread transport of at least one thread point or thread section; calculating, based on the measured values, approximation values of at least one dynamic process parameter which is characteristic of the thread transport for at least one thread point or thread section by means of a computation model; and evaluating the computed approximation values for monitoring the thread transport, the computation model containing model parameters, and at least some of the measured values being used as control parameters for the iterative adaptation of the model parameters.

14. Method in accordance with claim 13, with the computation model being designed as a simulation model for the thread transport, in particular as a simulation model in accordance with the method of finite elements.

15. Method for monitoring the transport of a thread in a weaving machine comprising transporting thread points or thread sections with an associated speed; measuring values of at least one measurement parameter which is dependent on the thread transport of at least one thread point or thread section; calculating, based on the measured values, approximation values of at least one dynamic process parameter which is characteristic of the thread transport for at least one thread point or thread section by means of a computation model; and evaluating the computed approximation values for monitoring the thread transport, wherein the computation model comprises a simulation model for the thread transport, and wherein the temporal variation of the approximation values of at least one dynamic process parameter which is characteristic for the thread transport is calculated for at least one thread point or thread section by means of the simulation model over a transport period.

16. Method for monitoring the transport of a thread in a weaving machine comprising transporting thread points or thread sections with an associated speed; measuring values of at least one measurement parameter which is dependent on the thread transport of at least one thread point or thread section; calculating, based on the measured values, approximation values of at least one dynamic process parameter which is characteristic of the thread transport for at least one thread point or thread section by means of a computation model; evaluating the computed approximation values for monitoring the thread transport; and calculating or evaluating the approximation values of a parameter which is dependent on the thread tensile force.

17. Method for monitoring the transport of a thread in a weaving machine comprising transporting thread points or thread sections with an associated speed; measuring values of at least one measurement parameter which is dependent on the thread transport of at least one thread point or thread section; calculating, based on the measured values, approximation values of at least one dynamic process parameter which is characteristic of the thread transport for at least one thread point or thread section by means of a computation model; and evaluating the computed approximation values for monitoring the thread transport, the values of at least one measurement parameter which is dependent on the thread transport being measured contactlessly, and/or with values of at least one of the following measurement parameters being measured: starting time in a predetermined position, arrival time at a predetermined position and displacement after a specific period of time or speed.

* * * * *